US007345252B2

(12) United States Patent
Takenaka et al.

(10) Patent No.: US 7,345,252 B2
(45) Date of Patent: Mar. 18, 2008

(54) KEY SWITCH

(75) Inventors: Hidemitsu Takenaka, Okayama (JP); Syunkichi Sasaki, Okayama (JP); Tetsuya Fukumoto, Okayama (JP); Mamoru Ito, Izumo (JP)

(73) Assignee: Omron Corporation, Kyoto-Shi (JP)

( * ) Notice: Subject to any disclaimer, the term of this patent is extended or adjusted under 35 U.S.C. 154(b) by 0 days.

(21) Appl. No.: 11/253,620

(22) Filed: Oct. 20, 2005

(65) Prior Publication Data

US 2006/0090992 A1 May 4, 2006

(30) Foreign Application Priority Data

Oct. 21, 2004 (JP) ..... 2004-307099

(51) Int. Cl.
*H01H 13/00* (2006.01)
*H01H 13/14* (2006.01)
*H01H 9/20* (2006.01)

(52) U.S. Cl. ..... 200/334; 200/43.11

(58) Field of Classification Search ..... 200/334, 200/43.11, 43.04, 43.07
See application file for complete search history.

(56) References Cited

U.S. PATENT DOCUMENTS 5,894,116 A * 4/1999 Da Dalt ..... 200/43.04
5,898,143 A * 4/1999 Da Dalt ..... 200/17 R
6,013,881 A * 1/2000 Hall et al. ..... 200/43.04
6,194,674 B1 * 2/2001 Fukui ..... 200/43.04
6,307,167 B1 * 10/2001 Kajio et al. ..... 200/43.11
6,720,508 B2 * 4/2004 Moriyama et al. ..... 200/200

FOREIGN PATENT DOCUMENTS

| | | |
|---|---|---|
| CN | 1095180 C | 11/2002 |
| DE | 39 43 375 | 7/1991 |
| EP | 0 871 188 | 10/1998 |
| EP | 0 977 227 | 2/2000 |
| EP | 0 977 228 | 2/2000 |
| JP | 06-076675 | 3/1994 |
| JP | 2004-079204 | 3/2004 |

* cited by examiner

*Primary Examiner*—Elvin Enad
*Assistant Examiner*—Lheiren Mae A. Anglo
(74) *Attorney, Agent, or Firm*—Foley & Lardner LLP

(57) ABSTRACT

A base head member has a cam body receiving portion in a center portion thereof, bridge portions are provided in both sides of the cam body receiving portion, a shaft bearing portion is provided in both the bridge portions, and the cam body is held in the base head member by receiving the cam body in the cam body receiving portion and bearing a cam shaft to the shaft bearing portion, and a contact portion is formed in right and left sides of a front face (a direction of pulling out an operation key) in a lower portion (a base portion) of a base main body, whereby the structure is made such as to receive a load applied to the cam shaft by a case from the contact portion.

19 Claims, 15 Drawing Sheets

KEY SWITCH

BACKGROUND OF THE INVENTION

1. Field of the Invention

The present invention relates to a key switch serving as a safety switch used in a door lock switch or the like.

2. Description of the Related Art

A door lock switch is generally structured such as to detect an opening and closing of a door provided in an entrance door of a working area in which an automated working machine is installed and turn on and off a power source of the working machine. When closing the door, an operation key provided in the door side is inserted to a key switch provided in the entrance side, a cam body is rotated by the inserted operation key, and a switching mechanism built in the key switch is changed to a switch-on state, whereby a power source circuit or the like is connected. Further, the structure is made such that a contact point switching state of the key switch by inserting the operation key by means of a lock means is maintained, and a lock by the lock means is cancelled by pulling out the operation key if the door is opened, whereby a cam body is rotationally operated, and a switching mechanism is changed to a switch-off state, so that the power source circuit or the like is disconnected.

The key switch in the door lock switch mentioned above is generally provided with a switch main body, and a head with a key insertion port mounted on an upper end of the switch main body and attached by a screw or the like. A pair of support tables for supporting the cam are assembled in the head, a cam shaft is bridged over the support tables, and the cam body is rotatably attached to the cam shaft (refer to Japanese Unexamined Patent Publication No. 6-76675).

SUMMARY OF THE INVENTION

In the key switch mentioned above, if it is intended to forcedly open the door in a locked state without executing a canceling operation of the lock achieved by the lock means, an overload is applied to the cam body via the operation key, the cam shaft is deformed on the basis of a bending moment applied to the cam shaft, the operation key is pulled out while the switching mechanism is kept in the switch-on state, the power source circuit is kept connected in spite that the door is open, and there is a risk that the working machine is kept operated.

The present invention is made by paying attention to the problem mentioned above, and an object of the present invention is to provide a key switch in which a bending moment applied to a cam shaft becomes small even if an overload is applied to a cam means, and the cam shaft is not deformed, whereby it is possible to improve a load withstand performance and make a diameter of the cam shaft small.

In order to achieve the object mentioned above, in accordance with the present invention, there is provided a key switch comprising:

a switch case receiving a switching means for executing an on-off operation and provided with a key insertion port of an operation key;

a base head member rotatably supporting a cam means which is rotated forward and backward by inserting and pulling out an operation key, thereby making the switching means execute a contact point switching operation, the base head member being received in the switch case so as to make the cam means face to the key insertion port; and a lock means maintaining a contact point switching state of the switching means on the basis of the insertion of the operation key, wherein a bridge portion fixedly holding the cam shaft holding the cam means is provided in a position close to the cam means of the base head member, and the base head member is fixedly held to the switch case.

In accordance with the structure mentioned above, if it is intended to forcedly pull out the operation key without executing the lock cancellation, the overload is applied to the cam means via the operation key in the direction of pulling out the operation key, and the overload is applied to the cam shaft so as to generate the bending moment in the cam shaft. However, since the base head member corresponding to a rigid body is fixed to the switch case, and the base head member has the bridge portion fixedly holding the cam shaft at the position close to the cam means, the bridge potion forms a support point portion of the cam shaft, a distance between a working point of the excessive force applied to the cam means and the bridge portion becomes small, and the bending moment applied to the cam shaft becomes small, whereby the cam shaft is not deformed, and it is possible to improve the load withstand performance and make the diameter of the cam shaft small.

Further, since the load withstand performance is improved, it is possible to reduce the problem that the operation key is pulled out while keeping the switching mechanism in the switch-on state, and the power source circuit is kept connected in spite that the door is opened, so that the working machine is kept operated.

In this case, for example, a switch for opening and closing a power source circuit is employed as the switching means, and for example, a cam body is employed as the cam means.

Further, in accordance with the present invention, there is provided with a key switch as recited in the invention mentioned above, wherein the base head member has a cam means receiving portion in a center portion thereof, the bridge portion is provided in a protruding manner in both side portions of the cam means receiving portion, and a contact portion brought into contact with the switch case is formed in a base portion side of the bridge portion.

In accordance with the structure mentioned above, since the base head member corresponding to the rigid body is fixed to the switch case, and the contact portion in the base portion side of the bridge portion is brought into contact with the switch case, the base head member is firmly fixed to the switch case, and it is possible to improve the load withstand performance.

Further, in accordance with the present invention, there is provided a key switch as recited in the invention mentioned above, wherein a dimension between both the bridge portions of the cam means receiving portion is made close to a width of the cam means.

In accordance with the structure mentioned above, the bridge portion comes close to both sides of the cam means, the bridge portion thereof forms the support point portion of the cam shaft, a distance between a working point of the excessive force applied to the cam shaft from the cam means and the bridge portion becomes small, the bending moment applied to the cam shaft becomes small, the cam shaft is not deformed, and it is possible to use the cam shaft having a small diameter.

Further, in accordance with the present invention, there is provided a key switch as recited in the invention mentioned above, wherein the lock means locks a head plunger which is reciprocated on the basis of the rotation of the cam means so as to make the switching means execute the contact point switching operation, and a convex portion for guiding the head plunger is formed in the cam means receiving portion.

In accordance with the structure mentioned above, it is possible to receive the force applied to the head plunger by the convex portion so as to release the force to the base head member, and it is possible to inhibit the head plunger from being deformed. Further, the bending moment applied to the head plunger becomes small, and it is possible to use the head plunger having the small diameter.

Further, in accordance with the present invention, there is provided a key switch as recited in the invention mentioned above, wherein the base head member is fixed to a wall surface portion of the switch case by a fixing member.

In accordance with the structure mentioned above, since the base head member corresponding to the rigid body is fixed to the switch case by the fixing member, the base head member is more firmly fixed to the switch case, and it is possible to improve the load withstand performance. In this case, for example, a fixing pin is employed as the fixing member.

Further, in accordance with the present invention, there is provided a key switch as recited in the invention mentioned above, wherein the base head member is constituted by a metal die-cast product.

In accordance with the structure mentioned above, a strength is increased in comparison with the base head member made of a synthetic resin, and it is possible to firmly hold the cam means by each of the shafts.

Further, in accordance with the present invention, there is provided a key switch as recited in the invention mentioned above, wherein the cam means has a plurality of cam bodies, and the cam bodies are arranged between both the bridge portions.

In accordance with the structure mentioned above, since the bridge portion is arranged between the cam bodies in the case that the cam means is constituted by a plurality of cam bodies, the bridge portion forms the support point portion of the cam shaft, the distance between the working point of the excessive force applied to the cam means and the bridge portion becomes small, the bending moment applied to the cam shaft becomes small, the cam shaft is not deformed, and it is possible to use the cam shaft having the small diameter.

In accordance with the key switch on the basis of the present invention, if it is intended to forcedly pull out the operation key without executing the lock cancellation, the overload is applied to the cam means via the operation key in the direction of pulling out the operation key, and the overload is applied to the cam shaft so as to generate the bending moment in the cam shaft. However, since the base head member corresponding to a rigid body is fixed to the switch case, and the base head member has the bridge portion fixedly holding the cam shaft at the position close to the cam means, the bridge potion forms a support point portion of the cam shaft, a distance between a working point of the excessive force applied to the cam means and the bridge portion becomes small, and the bending moment applied to the cam shaft becomes small, whereby the cam shaft is not deformed, and it is possible to improve the load withstand performance and make the diameter of the cam shaft small.

Further, since the load withstand performance is improved, it is possible to reduce the problem that the operation key is pulled out while keeping the switching mechanism in the switch-on state, and the power source circuit is kept connected in spite that the door is opened, so that the working machine is kept operated.

DESCRIPTION OF THE PREFERRED EMBODIMENTS

A description will be in detail given below of an embodiment in accordance with the present invention with reference to the accompanying drawings.

Figure 1:
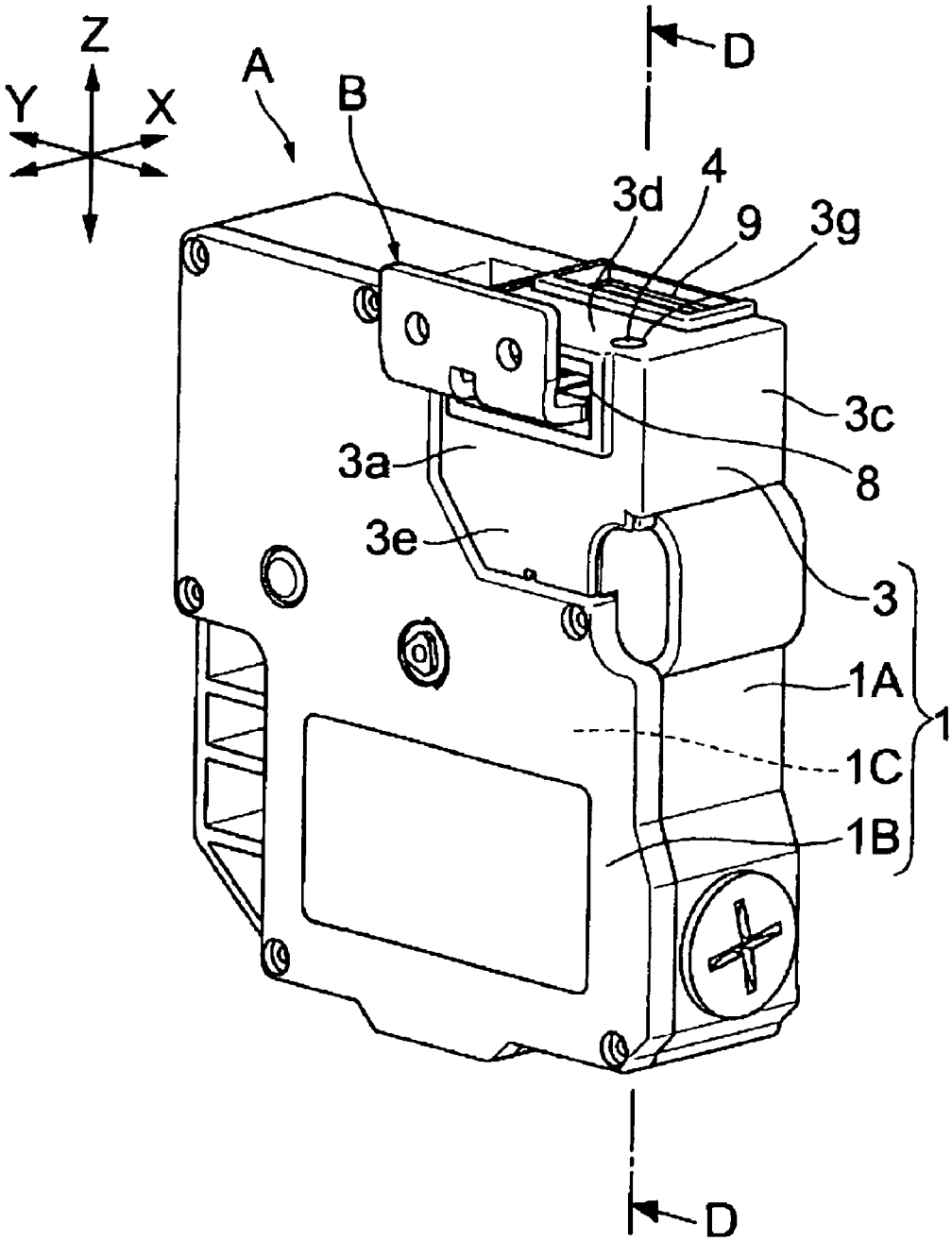
FIG. 1 shows a perspective view of a key switch in accordance with the present invention as seen from a front face.
Figure 2:
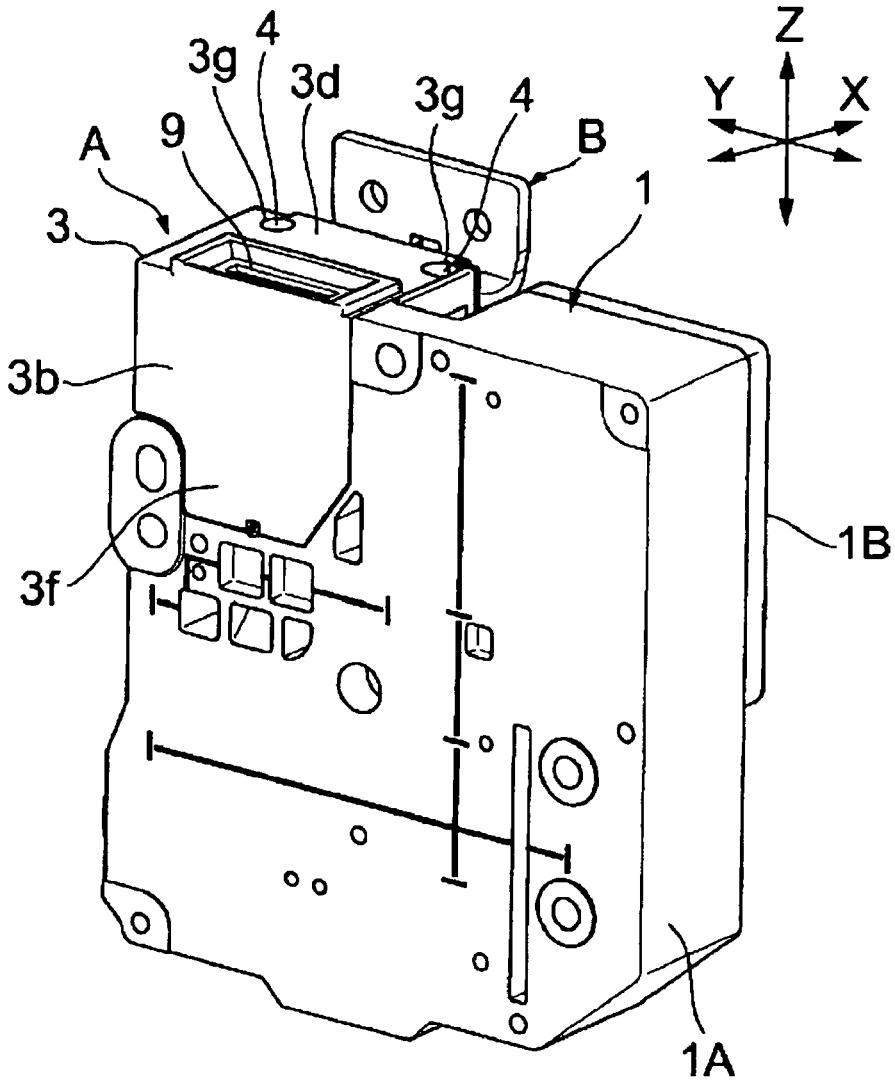
FIG. 2 shows a perspective view of the key switch as seen from a back face.
Figure 3:
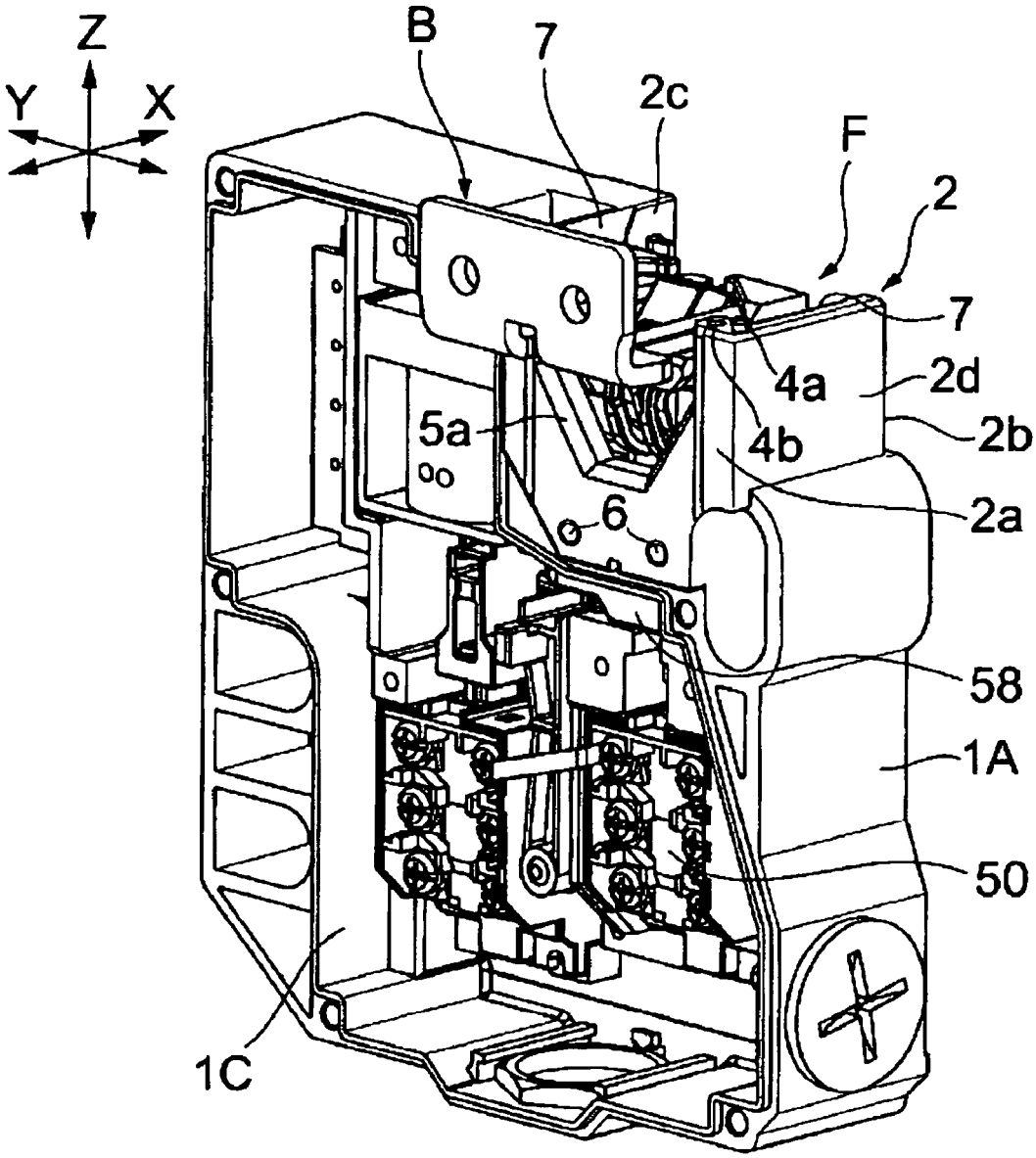
FIG. 3 shows a perspective view of a state in which a lid body and a head cover are detached in the key switch in accordance with the present invention as seen from a front face.
Figure 4:
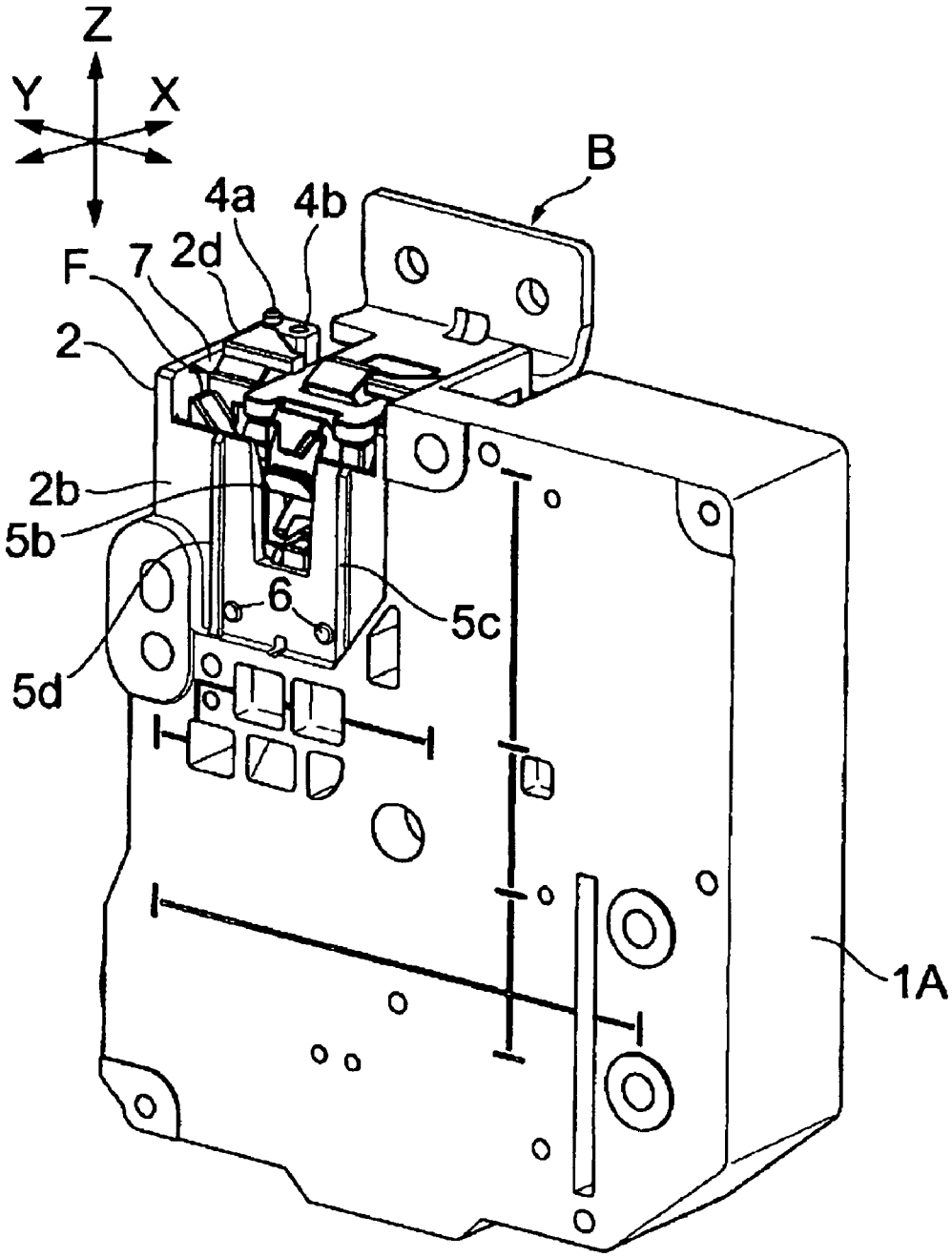
FIG. 4 shows a perspective view of the state in which the lid body and the head cover are detached in the key switch in accordance with the present invention as seen from a back face.
Figure 5:
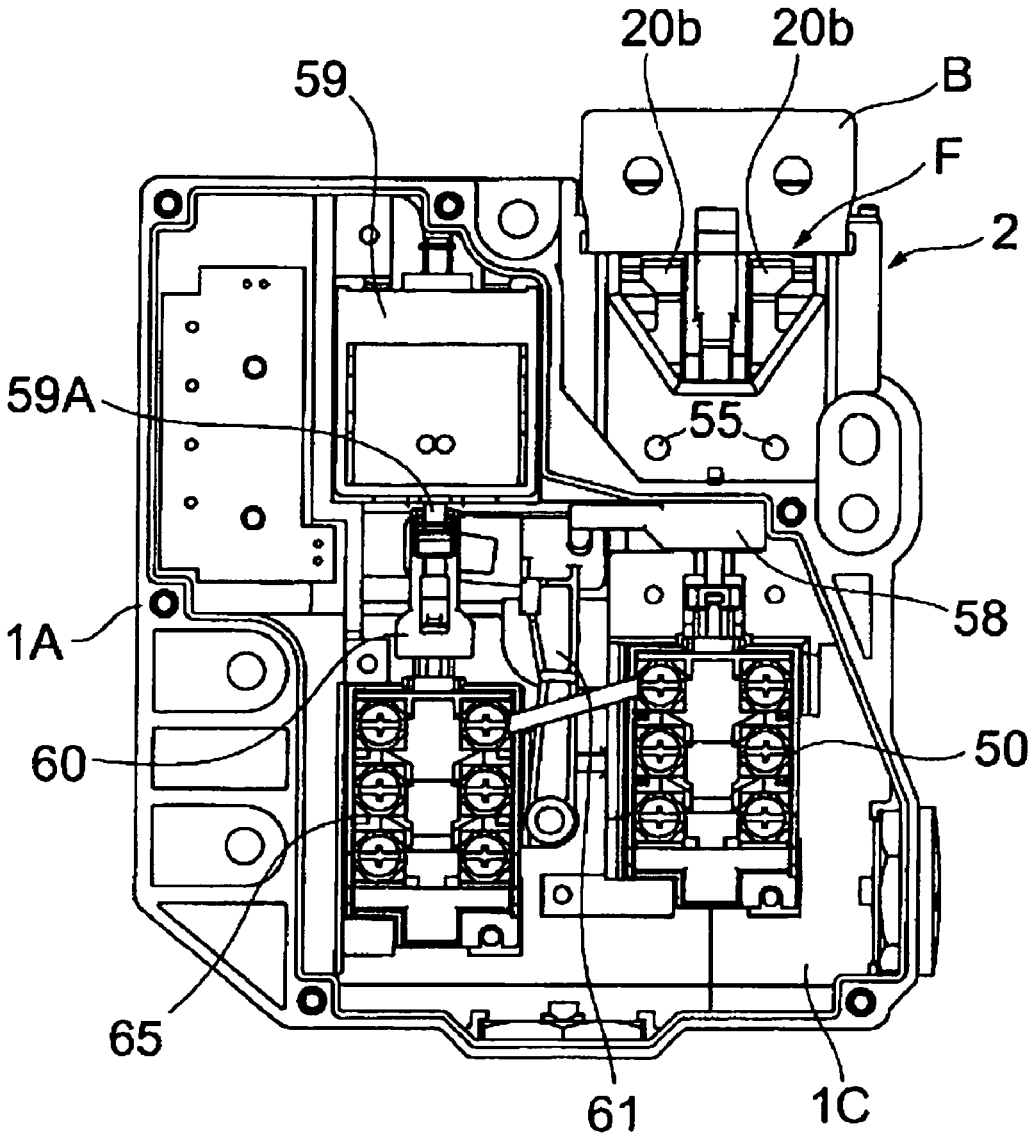
FIG. 5 shows a front elevational view of the state in which the lid body and the head cover are detached in the key switch in accordance with the present invention.
Figure 6:
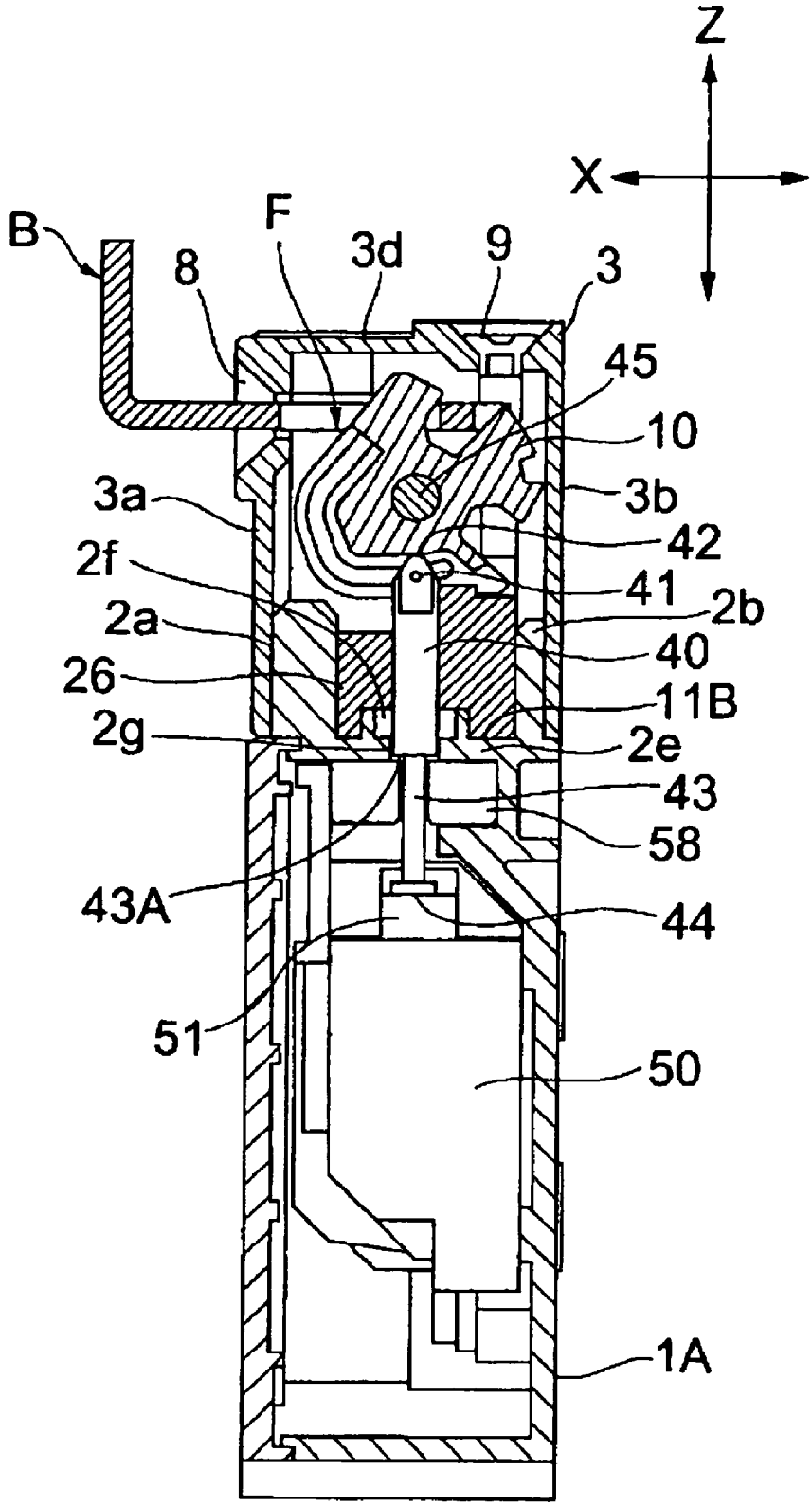
FIG. 6 shows a cross sectional view along a line D-D in FIG. 1 in a partly omitted manner.

FIG. 1 shows a perspective view of a key switch in accordance with the present invention as seen from a front face, FIG. 2 shows a perspective view of the key switch as seen from a back face, FIG. 3 shows a perspective view of a state in which a lid body and a head cover are detached in the key switch in accordance with the present invention as seen from a front face, FIG. 4 shows a perspective view of the state in which the lid body and the head cover are detached in the key switch in accordance with the present invention as seen from a back face, FIG. 5 shows a front elevational view of the state in which the lid body and the head cover are detached in the key switch in accordance with the present invention, and FIG. 6 shows a cross sectional view along a line D-D in FIG. 1 in a partly omitted manner. In this case, for convenience of explanation, a direction of inserting and pulling out an operation key B is set to a longitudinal direction X, and a lateral direction Y and a vertical direction Z are set as illustrated on the basis of the longitudinal direction X.

A key switch A in accordance with an embodiment of the present invention is provided with a switch case 1, and the switch case 1 is made of a synthetic resin. In this case, it may be made of a metal in accordance with the other embodiment of the present invention.

The switch case 1 is constituted by a box-shaped case 1A in which a front face is opened, a lid body 1B covering a front face opening portion 1C of the case 1A, and a head cover 3, as shown in FIGS. 1 and 2.

Figure 7:
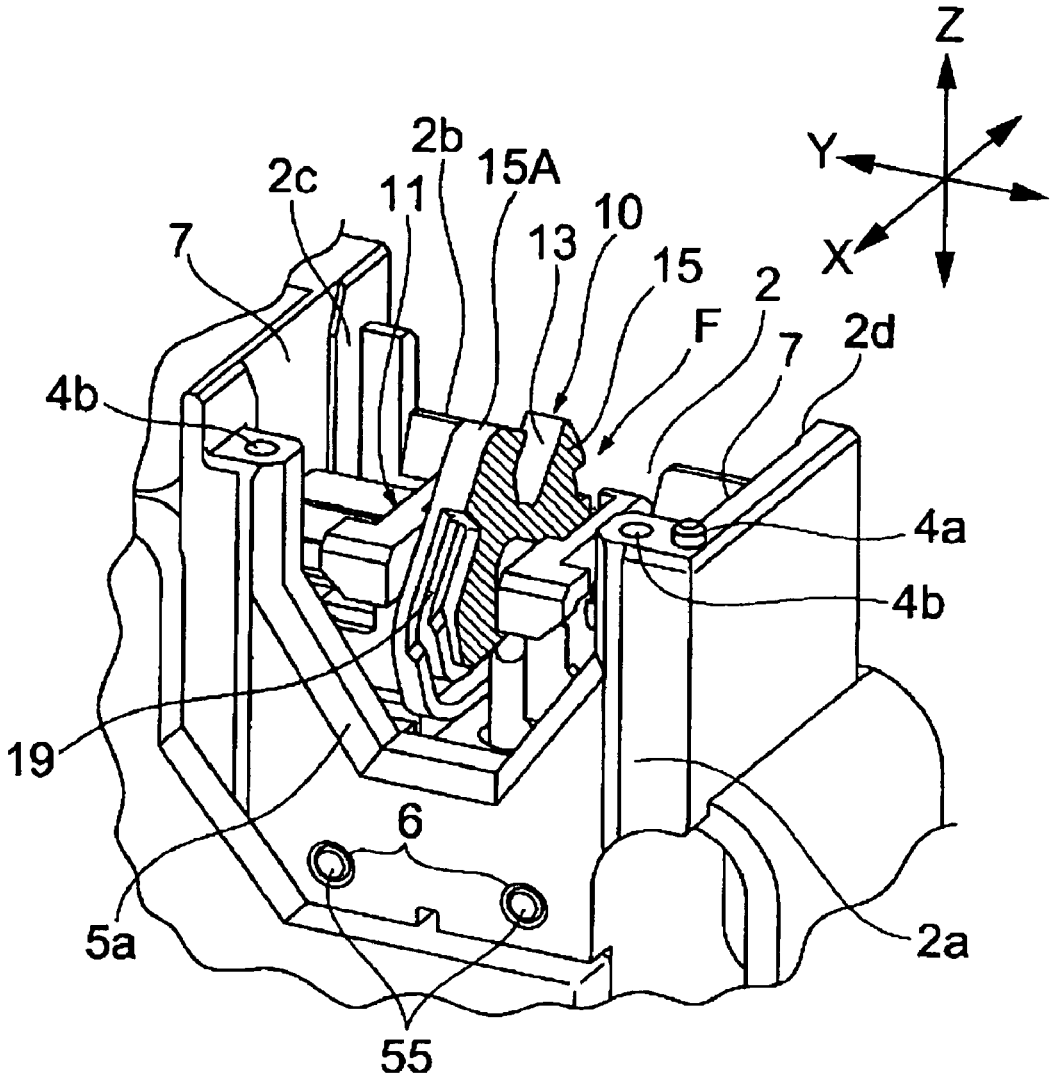
FIG. 7 shows a perspective view of a state in which a head cover is detached, in a head unit installation portion of the key switch in accordance with the present invention.

Further, as shown in FIGS. 3 and 7, a head unit installation portion 2 is formed in one side (a right side) of an upper portion of the case 1A. A head unit F is installed in the head unit installation portion 2, and the head unit F is covered with the head cover 3 by attaching the head cover 3 to the head unit installation portion 2.

The head unit installation portion 2 has front and rear face portions 2*a* and 2*b*, left and right face portions 2*c* and 2*d*, and a bottom face portion 2*e* (refer to FIGS. 6 and 7), and the upper face portion is opened. Further, the bottom face portion 2*e* is provided with a seal 2*f* and a hole portion 2*g* (refer to FIG. 6). Further, an engagement projection portion 4*a* is provided in a right corner portion in an upper edge portion of the front face portion 2*a*, and a stationary screw insertion hole portion 4*b* is provided in left and right sides of the upper edge portion of the front face portion 2*a*.

Approximately U-shaped notch portions 5*a* and 5*b* are formed in the front and rear face portions 2*a* and 2*b*, and cover fitting convex portions 5*c* and 5*d* are formed in an outer surface of the rear face portion 2*b* (refer to FIGS. 3 and 4). Further, a pair of left and right pin support hole portions 6 are formed in lower portions of the front and rear face portions 2*a* and 2*b*, and an insertion groove portion 7 extending along the vertical direction is formed in a center portion of an inner surface portion of each of the left and right face portions 2*c* and 2*d*.

The head cover 3 has front and rear face portions 3*a* and 3*b*, a right face portion 3*c* and a top face portion (an upper face portion) 3*d*, as shown in FIGS. 1 and 2, and the left face portion and the lower face portion are opened. Further, the front and rear face portions 3*a* and 3*b* have extension portions 3*e* and 3*f* in respective lower portions thereof. Further, the front face portion 3*a* (and the top surface portion 3*d*) are provided with a key insertion port 8 (9) inserting the operation key B thereto. Further, a thread hole portion 3*g* is provided in left and right sides of the top face portion 3*d*.

Figure 8:
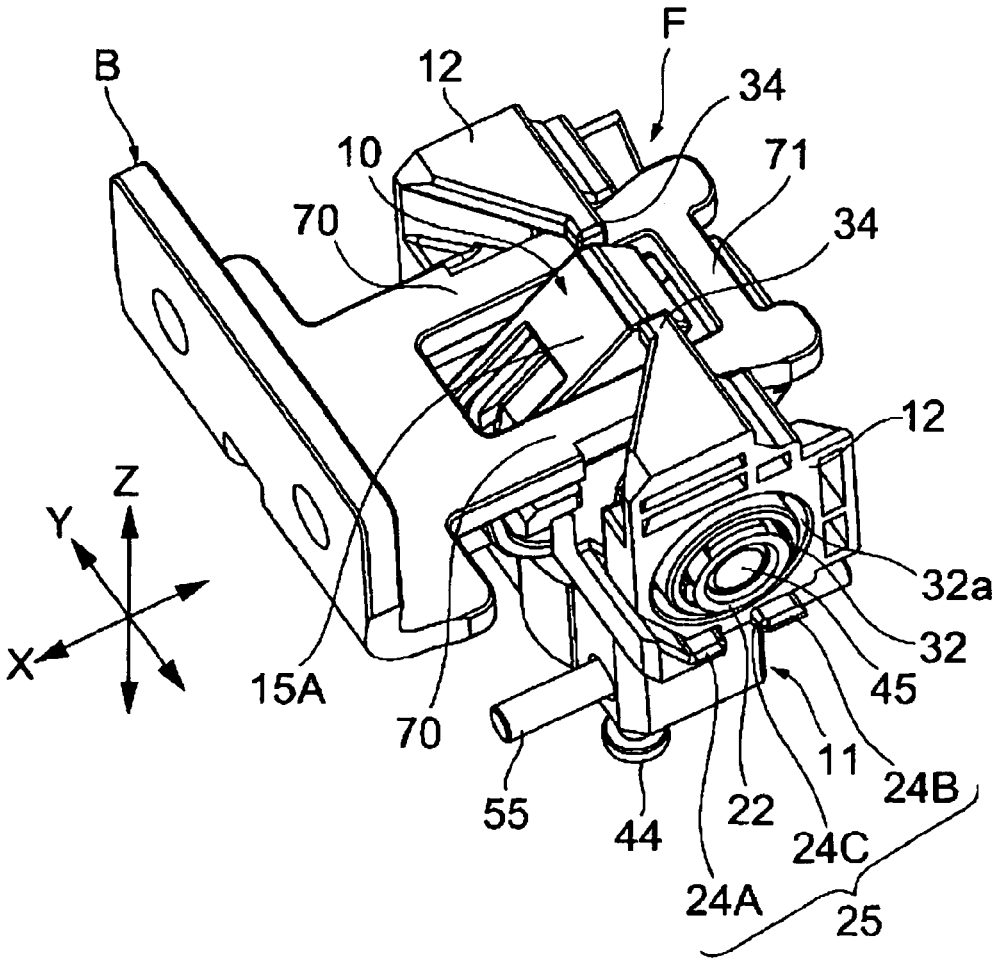
FIG. 8 shows a perspective view in which a head unit is seen from an upper portion of the front face.
Figure 9:
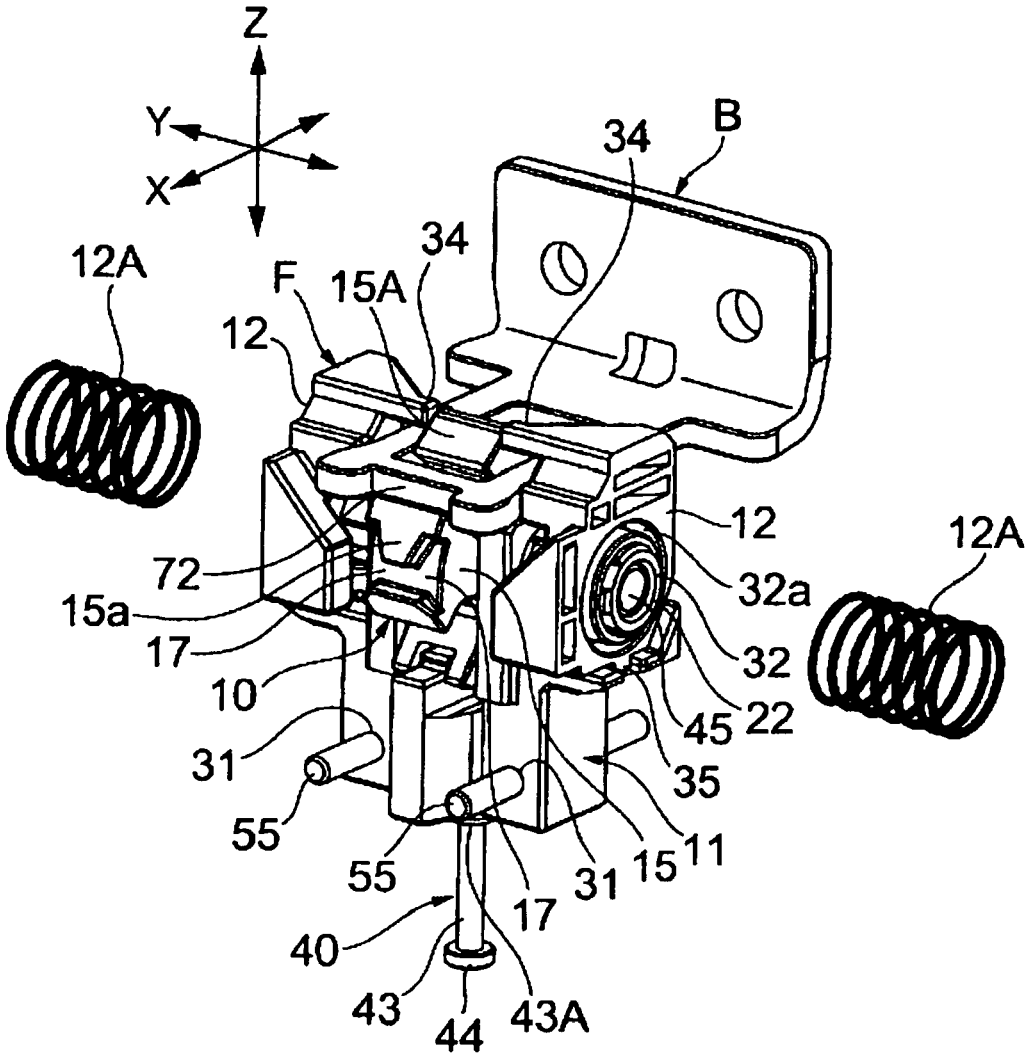
FIG. 9 shows a perspective view in which the head unit is seen from the back face.

The head unit F is constituted by a cam body 10 serving as a cam means rotating around a cam shaft (a support shaft) in correspondence to the insertion and pull-out of the operation key B, a base head member 11 to which the cam body 10 is rotatably attached by a cam shaft 45, a pair of head lock members 12 holding the cam body 10 at a rotated position at which the operation key B is pulled out, a pair of spring members 12A energizing the head lock members 12 to the cam body 10 so as to press, and a head plunger 40, as shown in FIGS. 8 and 9.

Figure 15:
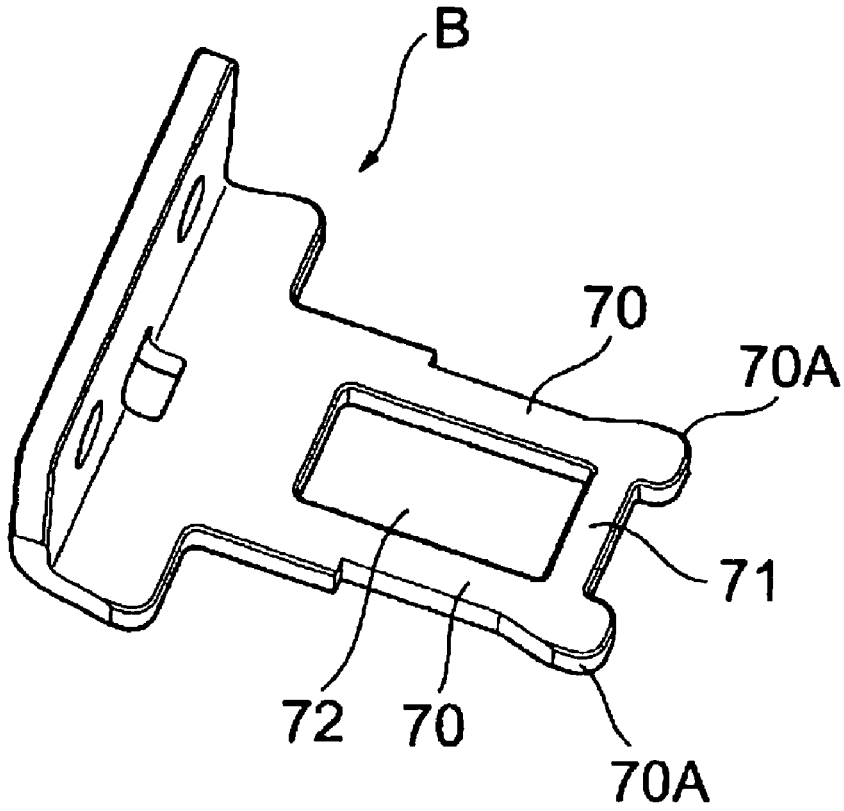
FIG. 15 shows a perspective view of the operation key.

The operation key B has branch portions 70 branched into two sections as shown in FIG. 15, and a coupling portion 71 coupling the branch portions 70, and further has a rectangular hole 72 receiving a part of a cam outer shape of the cam body at a time of inserting the operation key B to the key insertion port 8. Further, a bulge portion 70A bulging to an outer side is formed in a leading end portion of the branch portion 70.

The cam body 10 has a bearing hole 10A in a center portion thereof, and has front and rear key engagement portions 13 and 14 constituted by a concave portion, a convex portion 15 pinched by the key engagement portions 13 and 14, a convex portion 15A adjacent to the convex portion 15, and a cam portion 16 having an approximately U-shaped side surface, in a peripheral portion thereof. Further, a hole edge protruding portion 10B is formed around an edge of the bearing hole 10A in an outer surface of both the side surface portions of the cam body 10.

Figure 13:
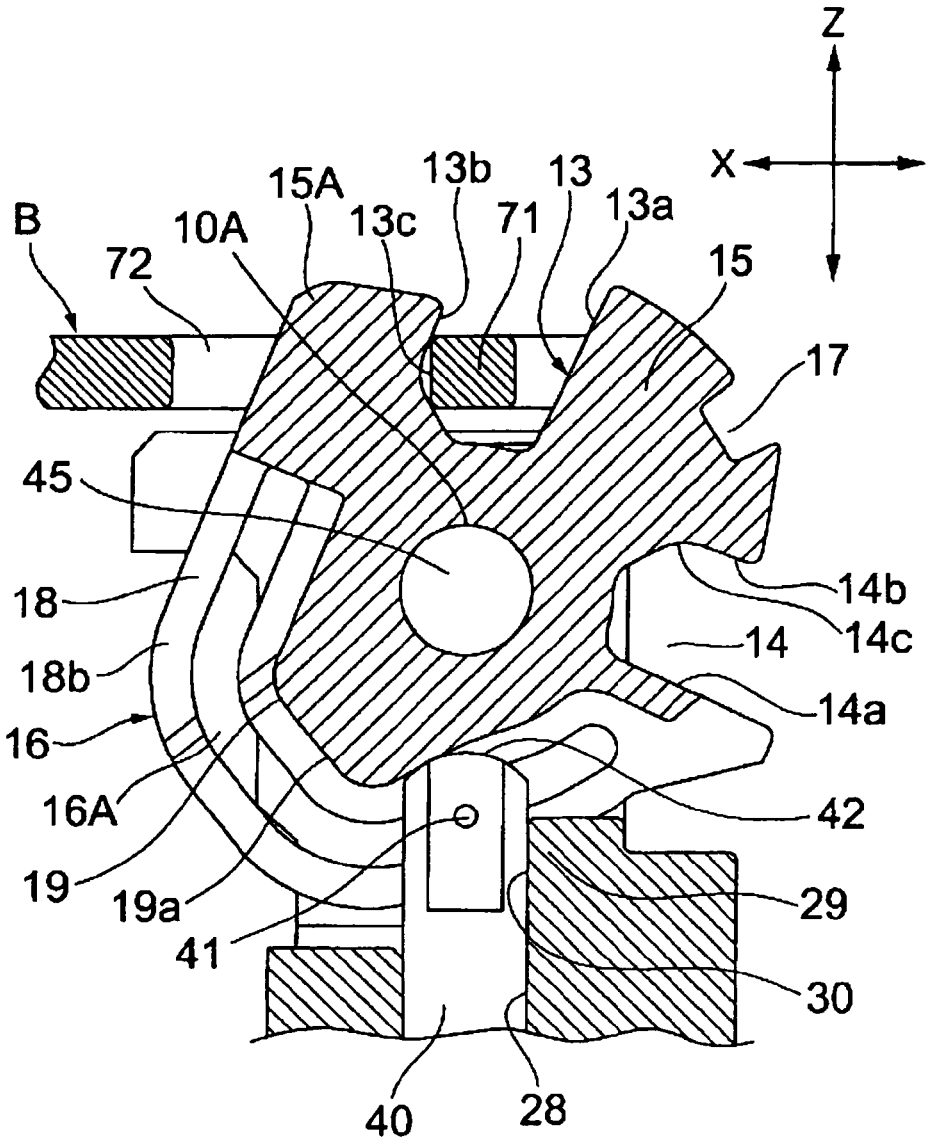
FIG. 13 shows an explanatory view of a state in which the head plunger is brought into slidable contact with a cam surface of the cam body.

Further, as shown in FIG. 13, the front side key engagement portion 13 is structured such that a rear line portion is formed as a passive pressure receiving portion 13*a* and a front line portion is formed as a returning pressure receiving portion 13*b*, and a key holding portion 13*c* having an approximately C-shaped side surface is formed in the returning pressure receiving portion 13*b*. In the same manner, the rear side key engagement portion 14 is structured such that a rear line portion is formed as a passive pressure receiving portion 14*a* and a front line portion is formed as a returning pressure receiving portion 14*b*, and a key holding portion 14*c* having an approximately C-shaped side surface is formed in the returning pressure receiving portion 14*b*. Further, as shown in FIG. 9, a lock groove portion 17 is formed in a top portion 15*a* of the convex portion 15 so as to be positioned right and left.

Figure 11:
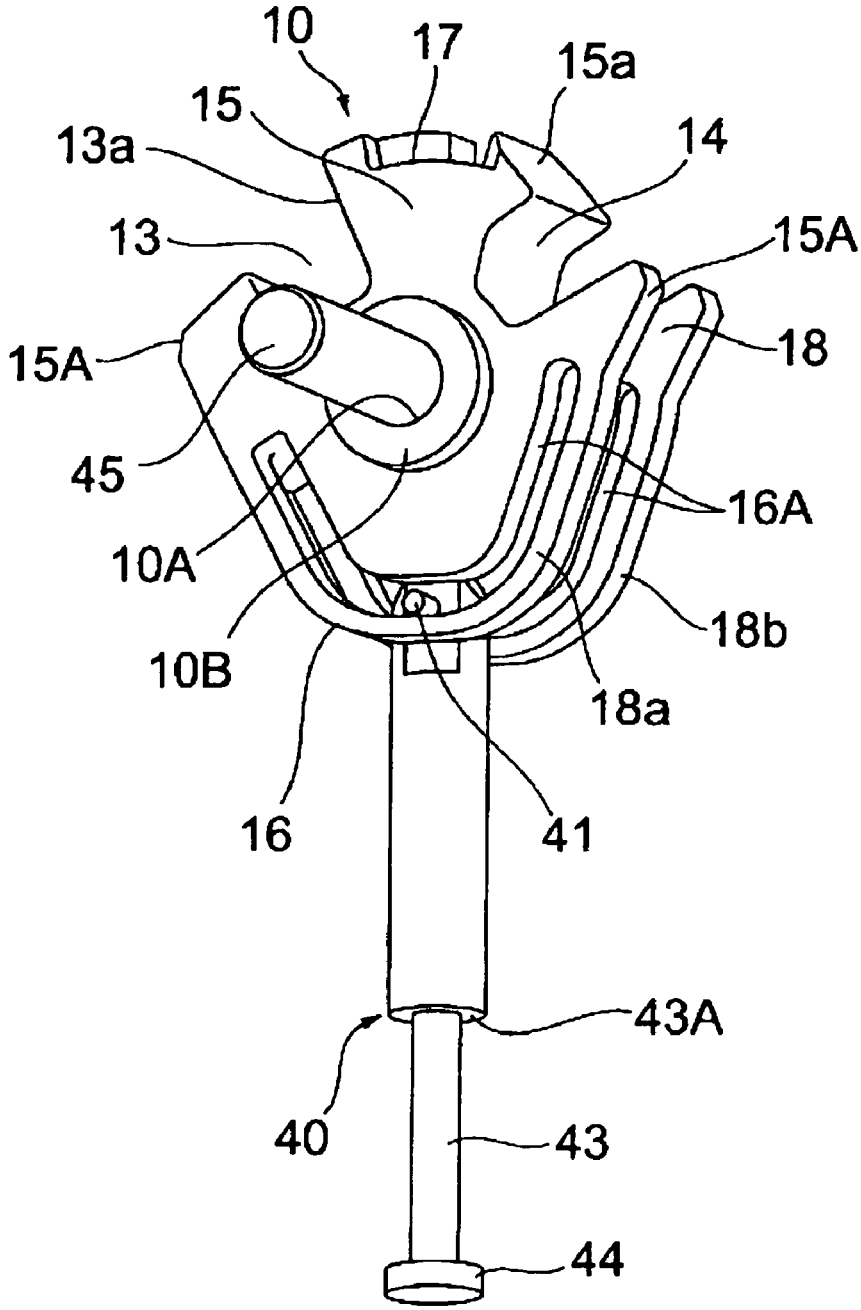
FIG. 11 shows a perspective view of a state in which a head plunger is coupled to a cam body.

Further, the cam portion 16 has a cam groove portion 18 formed in a lower half of a peripheral portion of the cam body 10, as shown in FIGS. 11 and 13, a bottom surface portion of the cam groove portion 18 is formed as a cam surface 19 having an approximately U-shaped side surface, and the cam surface 19 has a flat lower surface portion 19*a*. Further, a plunger guide hole portion 16A copying the cam surface 19 is formed in both side wall portions 18*a* and 18*b* of the cam groove portion 18.

Figure 10:
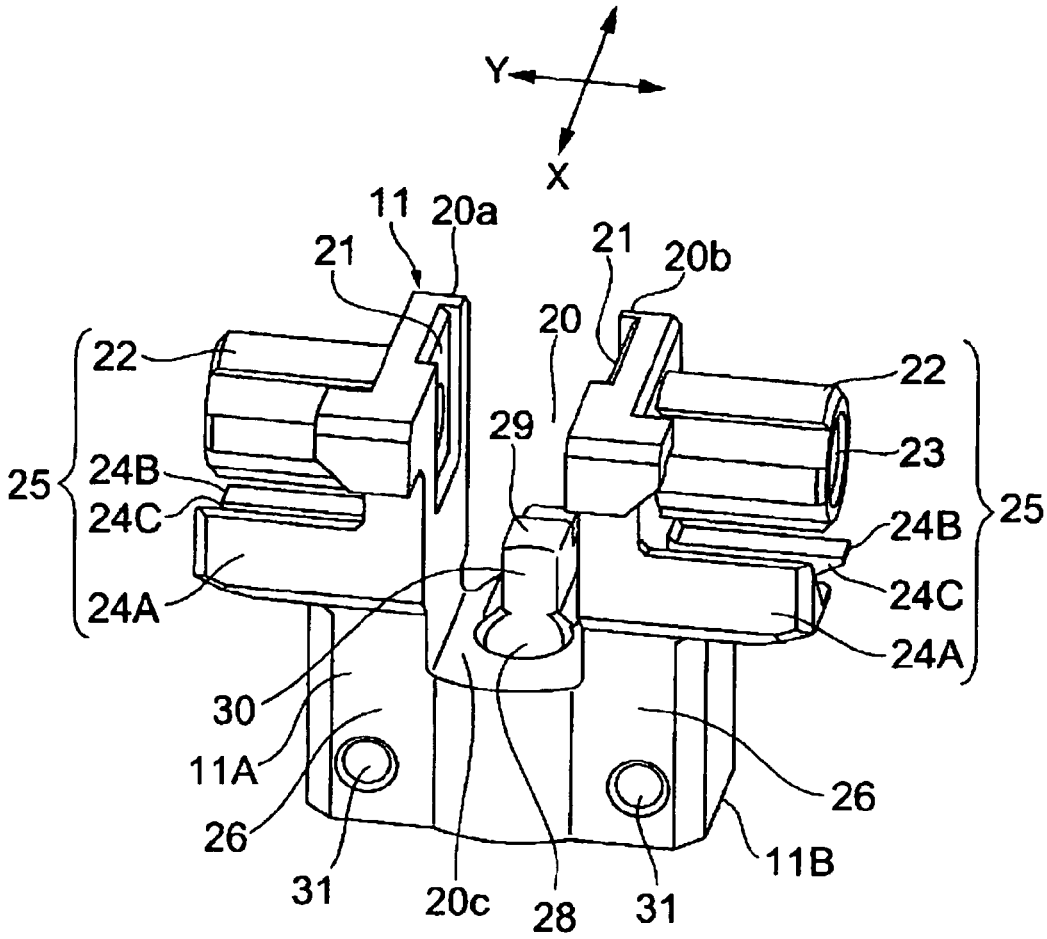
FIG. 10 shows a perspective view of a base member.

Further, the base head member 11 is made of a metal (a zinc alloy die-cast product), and has a base head main body 11A, as shown in FIG. 10. A cam body receiving body 20 corresponding to a cam means receiving portion is formed in a center of the base head main body 11A, bridge portions 20*a* and 20*b* are formed in both sides of the cam body receiving portion 20, a cam body insertion groove portion 21 is formed in inner surface portions of the bridge portions 20*a* and 20*b*, and a tubular shaft bearing portion 22 is provided in outer surface portions of both the bridge portions 20*a* and 20*b* so as to protrude toward an outer side. Further, a bearing hole portion 23 of the shaft bearing portion 22 is open to the cam body insertion groove portion 21.

Further, head lock member receiving portions 24A and 24B are provided in the outer surface portions of both the bridge portions 20*a* and 20*b* so as to protrude toward an outer side, and a portion between the head lock member receiving portions 24A and 24B is formed as a guide portion 24C. Further, a head lock member attachment portion 25 is constructed by the head lock member receiving portions 24A and 24B and the shaft bearing portion 22.

Further, as shown in FIG. 10, a contact portion 26 is formed in right and left sides of a front face (in a direction of drawing out the operation key B) of the lower portion (the base portion) of the base head main body 11A.

Further, a plunger insertion hole portion 28 is formed in a bottom portion 20*c* of the cam body receiving portion 20, a convex portion 29 forming a plunger guide is provided in a protruding manner so as to be positioned in a rear side of the plunger insertion hole portion 28, and a front face of the convex portion 29 is formed as a plunger guide surface portion 30 having a circular arc shape. Further, a pin hole portion 31 penetrating in a longitudinal direction (a direction of inserting and pulling out the key) X is formed in the left and right contact portions 26 of the base head main body 11A, and a bottom surface portion 11B of the base head main body 11A is formed flat.

Further, the head lock member 12 has a slidable hole portion 32 in an outer surface thereof, and a spring receiving portion 32*a* coaxially formed with the slidable hole portion 32, as shown in FIG. 9, has a cam lock portion 34 in a top portion and has a guide projection portion 35 in a lower surface portion, respectively.

The head plunger 40 is provided with a slidable pin 41 in an upper end portion thereof, as shown in FIGS. 11 and 13, a cam slidable portion 42 is formed in an upper end portion of the head plunger 40, a lower portion of the head plunger 40 is formed as a small-diameter shaft portion 43, and an engagement portion 44 is provided in an end portion of the small-diameter shaft portion 43 (a lower end portion of the head plunger 40). Further, a step portion 43A of the small-diameter shaft portion 43 is a position with which a lock member 58 mentioned below is engaged.

Next, a description will be given of an assembly of the head unit F.

The head plunger 40 is coupled to the cam body 10 by inserting the slidable pin 41 to the plunger guide hole portion 16A of the cam body 10 in an upper end portion thereof, as shown in FIGS. 11 and 13, and is structured such that the cam slidable portion 42 in the upper end portion of the head plunger 40 is brought into slidable contact with the cam surface 19 of the cam body 10.

Figure 12:
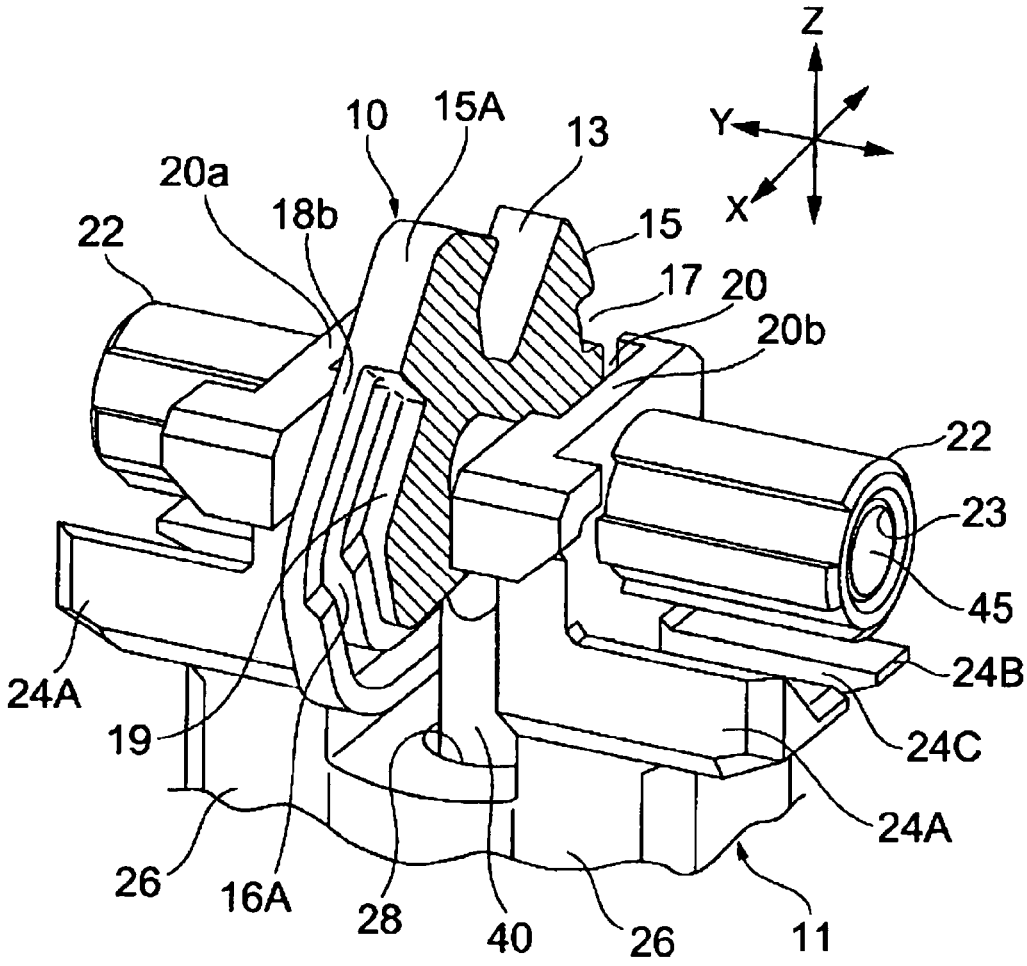
FIG. 12 shows a perspective view of a state in which the cam body assembled in the base member is broken in a partly omitted manner.

Further, the head plunger 40 is inserted to the plunger insertion hole portion 28 in the bottom portion 20*c* of the cam body receiving portion 20, as shown in FIGS. 12 and 13, and the cam body 10 is received in the cam body receiving portion 20. In this case, the plunger guide surface portion 30 of the convex portion 29 is brought into contact with the rear portion of the head plunger 40, and the head plunger 40 passes through the seal 2*f* of the bottom surface portion 2*e* of the head unit installation portion 2 and the hole portion 2*g*, as shown in FIG. 6. Further, the hole edge protruding portion 10B formed in the outer surface of both the side surface portions of the cam body 10 is inserted to the cam body insertion groove portion 21 (refer to FIGS. 11 and 12), and both the side surface portions of the cam body 10 come close to the inner surface portions of both the bridge portions 20*a* and 20*b* of the cam body receiving portion 20. Further, the cam shaft 45 is inserted to the bearing hole 10A of the cam body 10 and the bearing hole portion 23 of the shaft bearing portion 22, and the structure is made such that the cam body 10 rotates around the cam shaft 45.

Further, as shown in FIGS. 8 and 9, the head lock member 12 is attached to both the head lock member attachment portions 25 of the base head member 11 so as to be movable in the lateral direction Y. In other words, the head lock member 12 is received by the head lock member receiving portions 24A and 24B in a state in which the slidable hole portion 32 is inserted to the shaft bearing portion 22, and the guide projection portion 35 of the head lock member 12 is slidably inserted to the guide portion 24C.

Further, the head unit F assembled as mentioned above is installed in the head unit installation portion 2, for example, as shown in FIG. 7. In this case, the spring member 12A shown in FIG. 9 is arranged in the outer end portions of the left and right head lock members 12, the end portions of the spring members 12A are inserted to the insertion groove portions 7 in the inner surfaces of the left and right surface portions 2*c* and 2*d* of the head unit installation portion 2 in a state of compressing the spring members 12A, and the head lock member 12 is pressed to a center side of the base head member 11 on the basis of a repulsion force of the spring member 12A.

Further, as shown in FIG. 6, the contact portion 26 of the base head member 11 is brought into contact with the inner surface of the front face portion 2*a* of the head unit installation portion 2, a fixing pin 55 corresponding to the fixing member is inserted to a pair of pin hole portions 6 of the front and rear face portions 2*a* and 2*b* and a pin hole portion 31 of the base head member 11 (refer to FIGS. 7 and 9), and the base head member 11 is firmly fixed to the case 1A.

Further, as shown in FIGS. 1 and 2, the head cover 3 is covered on the head unit installation portion 2 so as to be aligned in the front and rear sides, and the head cover 3 is fixed to the head unit installation portion 2 by engaging the fixing screw 4 with the fixing screw insertion hole portion 4*b* from the thread hole portion 3*g*. Accordingly, the key insertion port 8 and the key insertion port 9 are respectively positioned at the front face portion of the key switch A and the upper face portion thereof.

Further, as shown in FIGS. 5 and 6, a circuit opening and closing switch 50 serving as a switching means of the working machine is provided within the case 1A. The circuit opening and closing switch 50 has a switch operation body 51, first, second and third movable contact points (not shown) equipped in the switch operation body 51, first, second and third stationary contact points (not shown), and a spring (not shown), and the engagement portion 44 in the lower end portion of the head plunger 40 is engaged with the switch operation body 51.

Further, the case 1A is provided with a lock means for inhibiting the operation key B from being drawn out at a time of inserting the operation key B to the key insertion port 8. The lock means is structured such that a lock member 58 is engaged with a step portion 43A of the head plunger 40 at an on operation time of the circuit opening and closing switch 50, thereby locking the head plunger 40 and inhibiting the rotation of the cam body 10, although a detail structure is not illustrated.

In this case, in the lock cancellation, the lock member 58 is moved by turning on an electromagnetic solenoid 59, thereby moving downward a movable plunger 59A of the electromagnetic solenoid 59 so as to move a coupling member 60 downward, and moving a lever 61 so as to move the lock member 58, whereby the lock of the head plunger 40 is cancelled.

Further, the case 1A is equipped with a lock checking switch 65 for checking the lock operation of the head plunger 40 by the lock means.

Next, a description will be given of an operation of the key switch A having the structure mentioned above with reference to a case that the key switch A is used as a safety switch in a door of a protection fence outside surrounding the working machine. In this case, an operation key B is attached to the door, and the key switch A is attached to a support post of the protection fence.

First, in a state in which the door is opened, the operation key B is pulled out of the key switch A, and in the key switch A, the cam lock portion 34 of the head lock member 12 is detachably engaged with the lock groove portion 17 of the convex portion 15 of the cam body 10 on the basis of the energizing force of the spring member 12A, and the cam body 10 is hold at an initial rotated position.

In this state, as shown in FIG. 11, the cam slidable portion 42 of the head plunger 40 is brought into contact with the lower surface portion 19*a* of the cam surface 19, thereby limiting the movement toward the upper side of the head plunger 40 and the switch operation body 51, and each of the movable contact points of the circuit opening and closing switch 50 is apart from each of the stationary contact points and is in a switch-off state. Further, the lock checking switch 65 is also in the switch-off state. Accordingly, in the door open state, the working machine or the like is not driven.

Next, when closing the door, the operation key B is inserted to the key insertion port 8, a leading end of a branch portion 70 of the operation key B is brought into contact with the inner surface portion of the head lock member 12 on the basis of the insertion of the operation key B, both the head lock members 12 are moved against the spring force of the spring member 12A, and the cam lock portion 34 of the head lock member 12 is detached from the lock groove portion 17 of the cam body 10, whereby the lock is cancelled and the cam body 10 can rotate.

The coupling portion 71 coupling the branch portions 70 of the operation key B pushes the passive pressure receiving portion 13*a* of the key engagement portion 13 on the basis of the further pressing of the operation key B, whereby the cam body 10 is rotated as shown in FIG. 13, the convex portion 15A in the outer peripheral portion of the cam body 10 is received in the receiving hole 72 of the operation key B, the plunger 40 is movable to the upper side on the basis of the rotation of the cam body 10, and the switch operation body 51 is moved upward by the spring force of the circuit opening and closing switch 50.

Each of the movable contact points is brought into contact with each of the stationary contact points on the basis of the movement toward the upper side of the switch operation body 51, the lock checking switch 65 is turned on, the power source circuit of the working machine or the like is turned on, and the working machine becomes in a drivable state.

Further, when the circuit opening and closing switch 50 is turned on, the lock means inhibiting the operation key B from being pulled out is operated, the lock member 58 is engaged with the step portion 43A of the head plunger 40 so as to lock the head plunger 40, inhibit the rotation of the cam body 10 and inhibit the switch operation body 51 from moving to the lower side.

Since the switch operation body 51 and the head plunger 40 can not move even if it is intended to pull out the operation key B, in the lock state in which the head plunger 40 is locked, the cam body 10 can not rotate, it is impossible to pull out the operation key B engaged with the cam body 10, and it is impossible to open the door. In other words, the locked state is established.

On the other hand, when opening the door of the working machine at the working time, a machine stop operation is first executed in the external operation portion, a signal indicating that the machine stops operation is detected from a rotation detector additionally provided in the working machine, and the electromagnetic solenoid 59 is excited. Accordingly, the movable plunger 59A is moved downward so as to descend the coupling member 60 and move the lever 61, thereby moving the lock member 58, and disconnecting the engagement of the lock member 58 with the step portion 43A so as to cancel the lock of the head plunger 40.

When pulling the door so as to open the door of the working machine, the coupling portion 71 of the operation key B is caught on the key holding portion 13*c* of the key engagement portion 13 of the cam body 10, and the cam body 10 is rotated in a counterclockwise direction in FIG. 13. Accordingly, the cam surface 19 of the cam portion 16 slides along the cam slidable portion 42 in the upper end of the head plunger 40, whereby the head plunger 40 is compressed. Accordingly, the switch operation body 51 is moved downward, each of the movable contact points of the circuit opening and closing switch 50 is moved apart from each of the stationary contact points, the lock checking switch 65 is turned off, the power source circuit of the working machine or the like is turned off, and the working machine becomes in a stop state.

When the door is opened and the operation key B is pulled out, the cam lock portion 34 of the head lock member 12 is detachably engaged with the lock groove portion 17 of the convex portion 15 of the cam body 10 on the basis of the energizing force of the spring member 12A, and the cam body 10 is held at the initially rotated position, in the key switch A.

Figure 14:
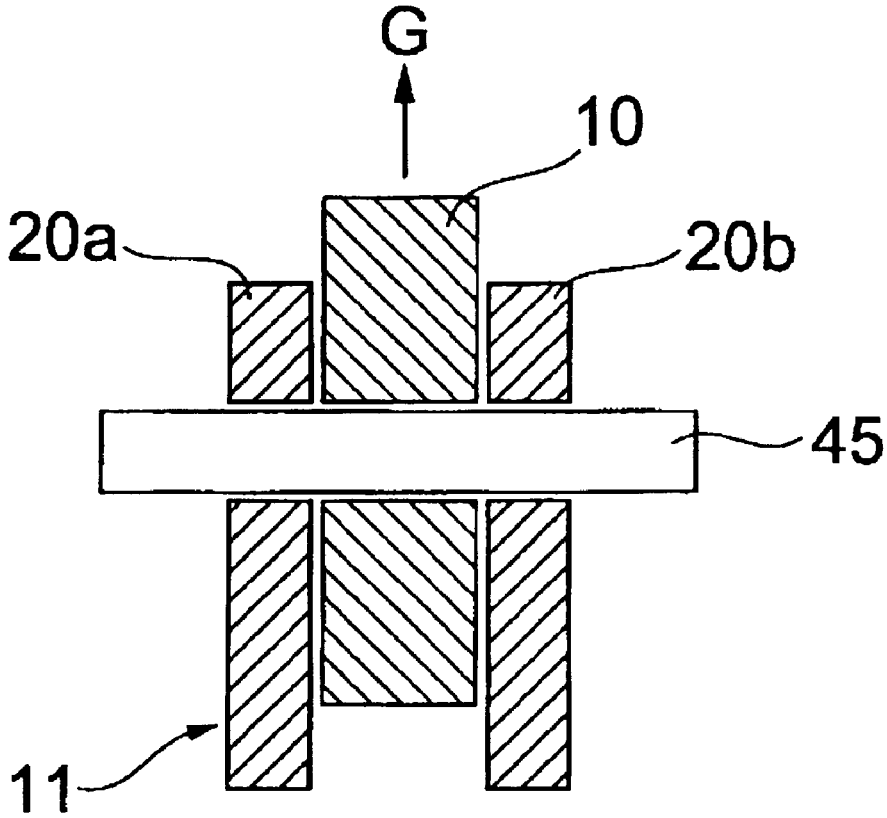
FIG. 14 shows an explanatory view of a case that an overload is applied to the cam body via an operation key in a direction of pulling out the operation key, and the overload is applied to the cam shaft.

Further, if it is intended to forcedly pull out the operation key B without executing the lock cancellation of the lock means mentioned above, an overload G in the direction of pulling out the operation key is applied to the cam body 10 via the operation key B, as shown in FIG. 14, the overload G is applied to the cam shaft 45, and the bending moment is generated in the cam shaft 45. However, since the base head member 11 corresponding to a rigid body is fixed to the case 1A, and the base head member 11 has the bridge portions 20*a* and 20*b* for fixing and holding the cam shaft 45 in the position close to the cam body 10, the bridge portions 20*a* and 20*b* form a support point portion of the cam shaft 45, a distance between the working point of the excessive force applied to the cam shaft 45 and the bridge portions 20*a* and 20*b* becomes small, the bending moment applied to the cam shaft 45 becomes small, and the cam shaft 45 is not deformed. Therefore, it is possible to improve a load withstand performance as well as it is possible to use the cam shaft 45 having the small diameter.

Further, since the load withstand performance of the cam shaft 45 is improved, it is possible to prevent the problem that the operation key B is pulled out while the circuit opening and closing switch 50 is held in the switch-on state, and the working machine is kept operated in a state in which the power source circuit is kept connected in spite that the door is opened.

Further, as shown in FIGS. 12 and 13, since the head plunger 40 is inserted to the plunger insertion hole portion 28 in the bottom portion 20C of the cam body receiving portion 20, and the plunger guide surface portion 30 of the convex portion 29 is brought into contact with the rear portion of the head plunger 40, it is possible to receive the force applied to the head plunger 40 by the base head member 11, and it is possible to inhibit the head plunger 40 from being deformed. Further, the bending moment in accordance with the head plunger 40 becomes small, and it is possible to use the head plunger 40 having the small diameter.

In accordance with the embodiment on the basis of the present invention mentioned above, the base head member 11 has the cam body receiving portion 20 in the center portion thereof, the shaft bearing portion 22 is provided in both the bridge portions 20*a* and 20*b* in both sides of the cam body receiving portion 20, the cam body 10 is held in the base head member 11 by receiving the cam body 10 in the cam body receiving portion 20 and bearing the cam shaft 45 to the shaft bearing portion 22, the head cover 3 is installed in the head unit installation portion 2 in a state in which these elements are received in the head unit installation portion 2, and the contact portion 26 in the base portion side of the bridge portions 20*a* and 20*b* is brought into contact with the inner surface of the front face portion 2*a* of the head unit installation portion 2, whereby the structure is made such as to receive the load applied to the cam shaft 45 by the case 1 from the contact portion 26. Accordingly, the base head member 11 is more firmly fixed to the case 1A, and it is possible to improve the load withstand performance.

Further, in accordance with the embodiment of the present invention, since the base head member 11 is manufactured by the metal die-cast, a strength is increased in comparison with the base head member 11 made of a synthetic resin, and it is possible to firmly hold the cam body 10 by the cam shaft 45. Accordingly, it is possible to make the base head member 11 thin and compact.

Further, in accordance with the embodiment of the present invention, since the base head member 11 is fixed to the wall surface portions (the front and rear face portions 2*a* and 2*b*) facing in the direction inserting and pulling out the operation key B of the head unit installation portion 2, it is possible to firmly fix the base head member 11 to the case 1A, and it is possible to increase the lock strength.

In this case, in the embodiment in accordance with the present invention mentioned above, and the cam means is constituted by the single cam body 10, and a pair of bridge portions 20*a* and 20*b* are positioned in both sides of the cam body 10. However, in the case that the cam means is constituted by a plurality of cam bodies 10, the bridge portions 20*a* and 20*b* may be arranged between the cam bodies 10.

In this case, since the bridge portions 20*a* 20*b* are arranged between the cam bodies 10, the bridge portion 20*a* and 20*b* form the support point portion of the cam shaft 45, the distance between the working point of the excessive force applied to the cam body 10 and the bridge portions 20*a* and 20*b* becomes small, the bending moment applied to the cam shaft 45 becomes small, the cam shaft 45 is not deformed, and it is possible to use the cam shaft 45 having the small diameter.

In accordance with the key switch on the basis of the present invention, if it is intended to forcedly pull out the operation key without executing the lock cancellation, the overload is applied to the cam means via the operation key in the direction of pulling out the operation key, and the overload is applied to the cam shaft so as to generate the bending moment in the cam shaft. However, since the base head member corresponding to a rigid body is fixed to the switch case, and the base head member has the bridge portion fixedly holding the cam shaft at the position close to the cam means, the bridge potion forms a support point portion of the cam shaft, a distance between a working point of the excessive force applied to the cam means and the bridge portion becomes small, and the bending moment applied to the cam shaft becomes small, whereby the cam shaft is not deformed, and there is obtained an effect that it is possible to improve the load withstand performance and make the diameter of the cam shaft small. Accordingly, the key switch is useful for the safety switch or the like used in the door lock switch or the like.

What is claimed is:

1. A key switch comprising:

a switch case housing a switching device for executing an on-off operation and provided with a key insertion port for an operation key;

a base head member rotatably supporting a cam device which is rotated forward and backward by inserting and pulling out the operation key, thereby making the switching device execute a contact point switching operation, the base head member being received in the switch case so as to make the cam device face to the key insertion port;

a lock device maintaining a contact point switching state of the switching device on the basis of the insertion of the operation key;

wherein a bridge fixedly holding a cam shaft holding the cam device is provided in a position close to the cam device of the base head member, and the base head member is fixedly held to the switch case;

wherein a shaft bearing portion is further provided in the bridge of the base head member toward the outside of the bridge; and wherein the lock device locks a head plunger which is reciprocated on the basis of the rotation of the cam device so as to make the switching device execute the contact point switching operation, and a convex portion for guiding the head plunger, said convex portion protruding upwardly from a bottom portion of a cam device receiving portion.

2. A key switch as claimed in claim 1, wherein the bridge comprises first and second bridge portions and a dimension between both the bridge portions is made close to a width of the cam device.

3. A key switch as claimed in claim 1, wherein the base head member comprises the cam device receiving portion in a center portion thereof, the bridge is provided in a protruding manner in both side portions of the cam device receiving portion, and a contact portion brought into contact with the switch case is formed in a base portion side of the bridge.

4. A key switch as claimed in claim 3, wherein the bridge comprises first and second bridge portions a dimension between both the bridge portions of the cam device receiving portion is made close to a width of the cam device.

5. A key switch as claimed in claim 1, wherein the base head member is fixed to a wall surface portion of the switch case by a fixing member.

6. A key switch as claimed in claim 1, wherein the base head member is constituted by a metal die-cast product.

7. A key switch as claimed in claim 1, wherein the bridge comprises first and second bridge portions; and wherein the cam device has a plurality of cam bodies, and the cam bodies are arranged between both the bridge portions.

8. A working tool assembly comprising:

a working tool;

an enclosure surrounding the working tool;

the enclosure further comprising a switch case comprising a switching device for executing an on-off operation of the working tool and provided with a key insertion port for an operation key;

a base head member rotatably supporting a cam device which is rotated forward and backward by inserting and pulling out the operation key, thereby making the switching device execute a contact point switching operation, the base head member being received in the switch case so as to make the cam device face to the key insertion port; and a lock device maintaining a contact point switching state of the switching device on the basis of the insertion of the operation key;

wherein a bridge fixedly holding a cam shaft holding the cam device is provided in a position close to the cam device of the base head member, and the base head member is fixedly held to the switch case;

wherein a shaft bearing portion is further provided in the bridge of the base head member toward the outside of the bridge; and wherein the lock device locks a head plunger which is reciprocated on the basis of the rotation of the cam device so as to make the switching device execute the contact point switching operation, and a convex portion for guiding the head plunger, said convex portion protruding upwardly from a bottom portion of a cam device receiving portion.

9. The working tool assembly as claimed in claim 8, wherein the bridge comprises first and second bridge portions and a dimension between the bridge portions is made close to a width of the cam device.

10. The working tool assembly as claimed in claim 8, wherein the bridge comprises first and second bridge portions, the base head member comprises the cam device receiving portion in a center portion thereof, the bridge portions are provided in a protruding manner in both respective side portions of the cam device receiving portion, and a contact portion brought into contact with the switch case is formed in a base portion side of the each bridge portion.

11. The working tool assembly as claimed in claim 8, wherein the bridge comprises first and second bridge portions and a dimension between the first and second bridge portions of the cam device receiving portion is made close to a width of the cam device.

12. The working tool assembly as claimed in claim 8, wherein the base head member is fixed to a wall surface portion of the switch case by a fixing member.

13. The working tool assembly as claimed in claim 8, wherein the base head member is constituted by a metal die-cast product.

14. The working tool assembly as claimed in claim 8, wherein the bridge comprises first and second bridge portions and the cam device has a plurality of cam bodies, and the cam bodies are arranged between both the bridge portions.

15. A method for locking the operation state of a machine, comprising:

inserting an operation key into a key insertion port of a switch case;

rotating a cam device supported by a base head member forward using the operation key, thereby making the switching device execute a contact point switching operation, the base head member being received in the switch case so as to make the cam device face to the key insertion port and wherein a shaft bearing portion is further provided in a bridge of the base head member toward the outside of the bridge;

locking the contact point switching state of the switching device upon insertion of the operation key by locking a head plunger;

locking a head plunger by reciprocating on the basis of the rotation of the cam device so as to make the switching device execute the contact point switching operation, and guiding the head plunger using a convex portion protruding upwardly from a bottom portion of a cam device receiving portion.

16. The method of claim 15, wherein the step of rotating a cam device is performed between first and second bridge portions that are separated by a width close to a width of the cam device.

17. The method of claim 16, wherein the step of rotating a cam device is performed on the cam device partially enclosed by a base head member which has the cam device receiving portion in a center portion thereof and wherein the first and second bridge portions are provided in a protruding manner on respective side portions of the cam device receiving portion, and a contact portion brought into contact with the switch case is formed in a base portion side of the bridge portion.

18. The method of claim 15, wherein the step of rotating a cam device is performed between first and second bridge portions fixedly holding a cam shaft holding the cam device and provided in a position close to the cam device of a base head member, wherein the base head member is fixedly held to the switch case.

19. The method of claim 18, wherein the first and second bridge portions are separated by a width close to a width of the cam device.

* * * * *